United States Patent [19]

Thibodeau

[11] 4,065,883

[45] Jan. 3, 1978

[54] WATER CONDUCTING MEMBERS SPACED BETWEEN SPACED EXPOSED BUILDING SUPPORT BEAMS

[76] Inventor: Leo Thomas Thibodeau, 2638 Kirklyn St., Falls Church, Va. 22043

[21] Appl. No.: 647,089

[22] Filed: Jan. 7, 1976

[51] Int. Cl.[2] ..... E04D 13/00

[52] U.S. Cl. ..... 52/11; 52/462; 52/478

[58] Field of Search ..... 52/11, 75, 537, 478, 52/13, 462, 78, 262, 90, 92, 14

[56] References Cited

U.S. PATENT DOCUMENTS

| | | | |
|---|---|---|---|
| 872,018 | 11/1907 | Repp | 52/462 |
| 2,899,719 | 8/1959 | Shapiro | 52/75 |
| 3,245,187 | 4/1966 | May | 52/478 |
| 3,286,404 | 11/1966 | Harrison | 52/75 X |

FOREIGN PATENT DOCUMENTS

| | | | |
|---|---|---|---|
| 1,203,089 | 1/1960 | France | 52/14 |
| 1,247,598 | 7/1962 | Germany | 52/14 |

*Primary Examiner*—Price C. Faw, Jr.
*Assistant Examiner*—Carl D. Friedman

[57] ABSTRACT

A simple and effective means for conducting water away from a building wherein exposed spaced beams are used as a supporting surface, such as used in a carport roof or a sundeck floor, comprised of an elongated tapered channel member positioned within the space between the beams and serving to receive water at one end and conducting it to a gutter disposed at the other end.

7 Claims, 6 Drawing Figures

Fig. 1
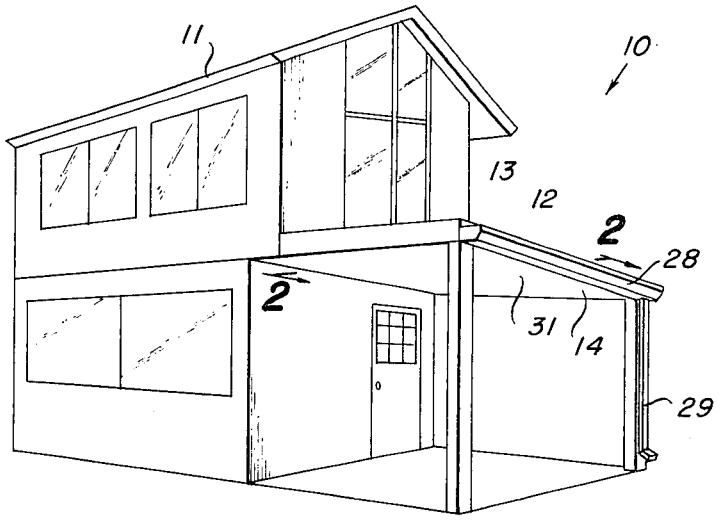
Fig. 2
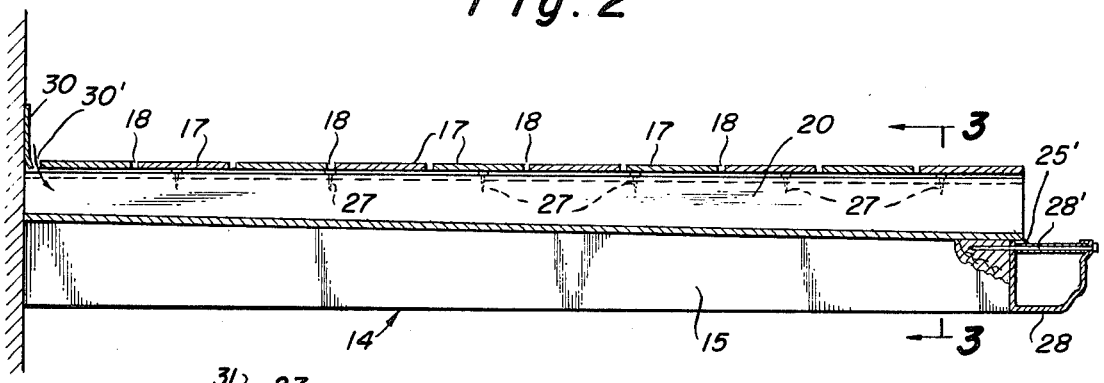
Fig. 3
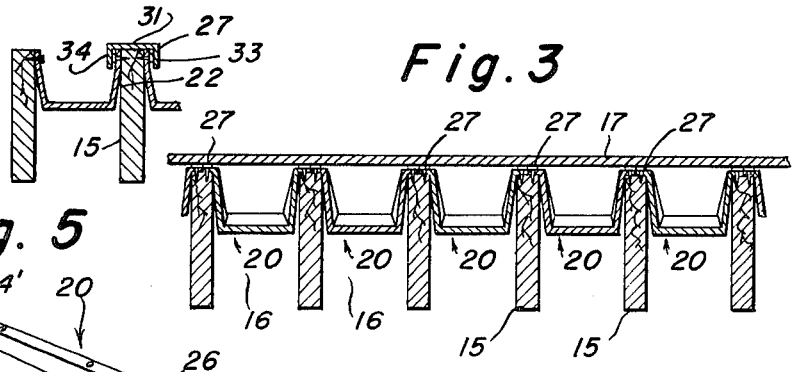
Fig. 6
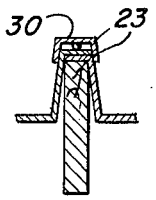
Fig. 5
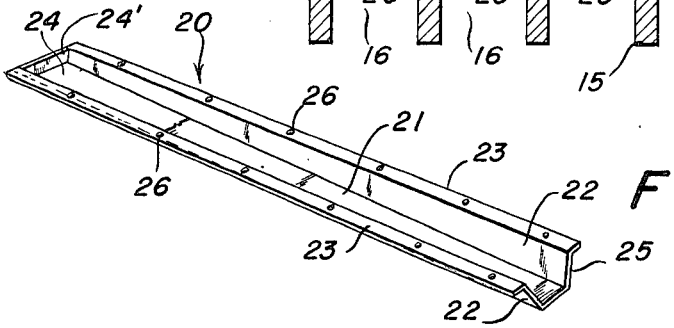
Fig. 4

WATER CONDUCTING MEMBERS SPACED BETWEEN SPACED EXPOSED BUILDING SUPPORT BEAMS

PRIOR ART GENERALLY

Normally no provision is made for conducting rainwater away from a main portion of a house through an auxiliary portion thereof wherein the same is comprised of a support surface made from underlying spaced beams having overlying spaced floor boards disposed perpendically thereto. The rainwater is allowed to pass through the openings provided by the spaces in the support surface to the level below. Obviously, the topography of the lower level must be such to permit the water to run off, otherwise, if the water is allowed to stand various attendant problems will arise.

BRIEF SUMMARY OF THE INVENTION

The present invention utilizes an elongated channel member made from sheet metal or plastic comprised of a base, upstanding side members, and outwardly extending flanges, with the flanges resting on the top of adjacent spaced beams for maintaining the members therebetween. The base is tapered downwardly from one end to the other to facilitate the flow of water.

It is therefrom an object of the invention to provide a drain means for conducting water through an open-framed construction without effecting the overall appearance of the same.

It is another object of the invention to provide a drain construction which is simple in design, economical to manufacture and easy to install.

These together with other and more specific objects and advantages will become apparent from a consideration of the following description of an exemplary embodiment when taken in conjunction with the drawing forming a part hereof.

BRIEF DESCRIPTION OF THE DRAWING

FIG. 1 is a perspective view of a house showing an auxiliary section wherein the invention is utilized;

FIG. 2 is a cross-sectional view though the roof of the auxiliary house section taken along the lines 2—2 thereof;

FIG. 3 is a sectional view taken the lines 3—3 of FIG. 2 showing the disposition of the novel channel member with respect to the support beams;

FIG. 4 depicts the channel member of the present invention; and

FIGS. 5 and 6 show modifications of the manner in which the channel members are secured to the support beams.

DESCRIPTION OF THE INVENTION

With reference to FIG. 1 of the drawing, a house shown generally at 10 comprises a main section 11 and an auxiliary section 12. The details of either section of the house are not important and the present invention is primarily concerned with conducting rainwater from the side 13 of main section 11 to the extremities of section 12. While the auxiliary section is depicted as a carport, it could obviously be designed as a sundeck. The important aspect of the construction is the details of the roof support 14. As seen in FIGS. 2 and 4 the support is comprised of a plurality of spaced alongated underlying beams 15, 15 etc., defining spaces 16, 16 etc., therebetween and having disposed thereover a plurality of spaced floor boards 17, 17 etc., defining spaces 18, 18 etc., therebetween. As is seen in FIG. 2, the spaces 18, 18 etc., permit water and other debris to pass therethrough into the spaces 16, 16 of the main beams.

The water conducting channels as seen in FIGS. 2, 3 and 4 are depicted generally as 20 and are of a length equal to that of the support beams 15 and are disposed in the spaces 16 thereof.

With continuing reference to FIG. 4, the channel member 20 is comprised of an elongated base 21, having upstanding side walls 22, 22 flaring outwardly from the base 21 and horizontal flanges 23, 23 extending from the tops of the side walls 22, 22 respectively. The side walls 22, 22 taper from a narrow portion at one end 24 to a wider portion 25 at its other end thereby causing the base 21 to slope downwardly when the channel is suspended from the beams 15, 15. An end Cap 24' formed in any fashion desired, closes end 24 of the channel member. Each of the flanges 23, 23 have spaced openings 26, 26 etc., along its length receiving nails, screws, 27, 27, etc., which serve to secure the channel 20 in place when the flanges 23, 23 are resting on the top of adjacent beams 15, 15 as clearly seen in FIG. 3. From an inspection of FIGS. 2 and 3 it is apparent that any water entering the channel 20 will run down its sloped base to be conducted away. In this instance, a gutter 28 attached to the end of the beams 15 by elongated nails 28' is disposed below the level of the channels 20 with the ends 25 thereof positioned well within the interior of the gutter to collect the water therefrom and conduct it to a downspout 29 where it is discharged in the normal fashion. A lip 25' can be formed on the end 25 of the channel 20 to prevent water from seeping rearwardly into the beams. Additionally, a plate 30 extending the length of the auxiliary section 12 can be secured to the side of the house for facilitating the introduction of the water into the end of the channel members 20 positioned adjacent thereto. The plate 30 is curved at its lower end to control the water flow into the channels as shown by the arrow 30. The aforementioned end cap 24' is disposed beneath the curved portion of the plate 30 and prevents water from engaing the house wall.

In use, and is apparent, the elongated channel members 20, 20 are placed in the spaces between the main beams 15, 15 with the flanges 23, 23 engaging the top surface thereof. They are maintained in a suspended position by driving nails 27, 27 or the like into the beams 15 through the opening 26, 26. Thereafter the floor boards are nailed transversely over the tops of the beams 15 and flanges 23 to complete the surface.

Alternative methods of mounting the channel members onto the beams 15 are seen in FIGS. 5 and 6. In the FIG. 5 embodiment, the flanges 23 have been removed and the securing means 27 are driven through the walls 22 into the beams 15. A cap member 31, 32, U-shaped in cross section, straddles the beam with its base and its legs 33, 34 covering the topmost portion of adjacent walls 22 secured to opposite sides of the beam 15.

In the FIG. 6 embodiment, the flanges 23 of adjacent channel members 20 next one upon the other, with the cap member 30 positioned thereover in the manner of the FIG. 5 embodiment. The cap member is shown in a raised position to show the positioning of adhesive therebeneath for securing the cap to the topmost flange.

If desired, the channel members can be concealed by securing wallboards, panels, etc., to the lower portions of the beams 15 as shown at 31 in FIG. 1 without affecting the operation of the members 20.

Alternatively, the structure can be left open and the channel members can be painted, or coated the same color as the beams and floor boards without affecting the overall appearance of the same.

It is therefore shown that with the present invention no provision has to be made to slant the support structure to insure that water will run therefrom. Also, if the support structure is to be used as a sundeck, the present invention provides a simple way of cleaning the same as the water will run between the spaces and carry dirt with it into the channels 20 and thereafter into the gutters.

The channel members 20 can be stamped from sheet metal, formed from plastic or any other suitable material. The channel members can be simply made by taking an elongated U-shaped duct member and scoring the side walls in a tapering fashion from one end to the other, for example, from end 25 to end 24 as seen in FIG. 4, and severing the walls along the scored lines. The end product will then be of the embodiment as shown in FIG. 5. Thereafter, the flanges 23 can be turned down if so desired.

I claim:

1. A horizontal support surface comprising a plurality of spaced apart elongated beams, an elongated unitary channel member disposed in each of the spaces and being of substantially the same length as said beams and of a width substantially filling the space for conducting fluid therethrough, each of said channel members being comprised of a base, side walls extending upwardly from opposite sides of the base, said side walls tapering from a narrow portion at one end to a wider portion at the other end causing said base to slope downwardly from said one end to said other end, means securing said side walls of each channel member to the beams adjacent thereto, and spaced apart horizontally disposed floor boards positioned transversely over and substantially covering the alternating beams and channel members, and means securing the floor boards to the beams.

2. The channel members of claim 1, further including substantially disposed horizontal flanges extending outwardly from the side walls, with the flanges of adjacent channel members nesting one on top of the other on the beams adjacent thereto.

3. The channel member of claim 1 wherein each of the support beams are connected at one end to a wall and support a gutter along the opposite end thereof, said gutter being disposed below said other ends of each of the channel members to collect water therefrom and conduct it away.

4. The channel members of claim 3 wherein a water guiding plate is connected to said wall above the channel members conducting water thereto.

5. The channel members of claim 1 wherein flanges extend substantially horizontally outwardly from the top portion of the side walls and are secured to the top of the beams adjacent thereto.

6. The channel members of claim 5 wherein a cap member straddles and encompasses the flanges to make the same watertight.

7. The channel members of claim 1 wherein a cap member straddles and encompasses the top of the side walls making the same watertight.

* * * * *